US011083223B2

(12) United States Patent
Chen

(10) Patent No.: US 11,083,223 B2
(45) Date of Patent: Aug. 10, 2021

(54) ELECTRONIC CIGARETTE AND ATOMIZER THEREOF

(71) Applicant: Shenzhen Smoore Technology Limited, Shenzhen (CN)

(72) Inventor: Zhiping Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 366 days.

(21) Appl. No.: 16/306,926

(22) PCT Filed: Jul. 29, 2016

(86) PCT No.: PCT/CN2016/092244
§ 371 (c)(1),
(2) Date: Dec. 4, 2018

(87) PCT Pub. No.: WO2018/018599
PCT Pub. Date: Feb. 1, 2018

(65) Prior Publication Data

US 2019/0223504 A1 Jul. 25, 2019

(51) Int. Cl.
*A24F 40/46* (2020.01)
*A24F 40/42* (2020.01)
(Continued)

(52) U.S. Cl.
CPC ..... *A24F 40/46* (2020.01); *A24F 40/42* (2020.01); *A24F 40/44* (2020.01); *A24F 40/485* (2020.01); *A24F 40/10* (2020.01)

(58) Field of Classification Search
CPC ..... A24F 47/008; A24F 40/46; A24F 40/42; A24F 40/44; A24F 40/485; A24F 40/10
See application file for complete search history.

(56) References Cited

U.S. PATENT DOCUMENTS

2013/0228191 A1* 9/2013 Newton ..... A61M 15/06 131/329
2014/0007891 A1* 1/2014 Liu ..... A24F 47/002 131/329
(Continued)

FOREIGN PATENT DOCUMENTS

CN 101606758 A 12/2009
CN 203015837 U 6/2013
(Continued)

OTHER PUBLICATIONS

Zhang, Jing, PCT/CN2016/092244, International Search Report, dated Apr. 12, 2017, 3 pages.

*Primary Examiner* — Alex B Efta
(74) *Attorney, Agent, or Firm* — Mark Malek; Widerman Malek, PL

(57) ABSTRACT

Provided are an electronic cigarette and an atomizer thereof, wherein an atomizer (10) comprises a liquid storage assembly (100) and an atomization assembly (200). The liquid storage assembly (100) comprises a plastic outer tube (120) and a metal inner tube (140). The plastic outer tube (120) comprises an outer tube body (122) and a connecting portion (124) provided in the outer tube body (122), wherein the connecting portion (124) is integrally connected to the outer tube body (122). The metal inner tube (140) is provided in the outer tube body (122), and the metal inner tube (140) is directly connected to the connecting portion (124). The interior of the metal inner tube (140) forms an air inlet passage (142), and a liquid storage chamber (160) is formed between the plastic outer tube (120) and the metal inner tube (140). The atomization assembly (200) is used to suction cigarette liquid in the liquid storage chamber (160) and atomize same. The atomization assembly (200) is provided
(Continued)

with an airflow passage (210), and the airflow passage (210) is in communication with the air inlet passage (142).

20 Claims, 7 Drawing Sheets

(51) Int. Cl.
*A24F 40/44* (2020.01)
*A24F 40/485* (2020.01)
*A24F 40/10* (2020.01)

(56) References Cited

U.S. PATENT DOCUMENTS

2014/0283855 A1* 9/2014 Hawes ..... A24F 40/485 131/328
2014/0299140 A1 10/2014 Liu
2015/0150306 A1* 6/2015 Chen ..... A24F 40/40 131/329
2015/0150307 A1* 6/2015 Liu ..... H01M 50/213 131/329
2016/0100633 A1* 4/2016 Gao ..... A24F 47/008 131/329

FOREIGN PATENT DOCUMENTS

| | | | |
|---|---|---|---|
| CN | 203182017 | U | 9/2013 |
| CN | 103960780 | A | 8/2014 |
| CN | 104013108 | A | 9/2014 |
| CN | 203952433 | U | 11/2014 |
| CN | 204499489 | U | 7/2015 |
| CN | 104872822 | A | 9/2015 |
| CN | 105192895 | A | 12/2015 |
| CN | 105455199 | A | 4/2016 |
| CN | 105559147 | A | 5/2016 |
| EP | 3061356 | A1 | 8/2016 |

* cited by examiner

ELECTRONIC CIGARETTE AND ATOMIZER THEREOF

TECHNICAL FIELD

The present disclosure relates to the technical field of smoking device, particularly relates to an electronic cigarette and an atomizer thereof.

BACKGROUND

Electronic cigarette is also known as a virtual cigarette. An atomizer of the electronic cigarette is used to storage e-liquid and atomize the e-liquid. In order to he convenient to carry and use, the volume of the atomizer is generally small, and the space of the atomizer for storing the e-liquid is also relatively small. Therefore, the conventional atomizer has a less amount of liquid storage, and cannot meet the needs.

SUMMARY

Accordingly, it is necessary to provide an electronic cigarette and an atomizer thereof that can increase the amount of liquid storage.

An atomizer of an electronic cigarette includes a liquid storage assembly and an atomizing assembly;

the liquid storage assembly includes a plastic outer tube and a metal inner tube, the plastic outer tube includes an outer tube body and a connecting portion located in the outer tube body, and the connecting portion is integrally connected to the outer tube body; the metal inner tube is located in the outer tube body, and the metal inner tube is directly connected to the connecting portion; the metal inner tube defines an air inlet passage therein, and the plastic outer tube and the metal inner tube form a liquid storage chamber therebetween; and the atomizing assembly is connected to the liquid storage assembly, the atomizing assembly is used to absorb e-liquid in the liquid storage chamber and atomize the e-liquid; the atomizing assembly defines an airflow passage in communication with the air inlet passage.

An electronic cigarette includes a battery device and an aforementioned atomizer, the battery device is connected to the atomizer to supply power to the atomizer.

According to the aforementioned electronic cigarette and the atomizer thereof, the liquid storage assembly includes the plastic outer tube and the metal inner tube, wherein the metal inner tube can be very thin, and the thin metal inner tube is capable to ensure the structural strength, thereby increasing the volume of the liquid storage chamber and increasing the amount of liquid storage. Further, the metal inner tube is directly connected to the connecting portion of the plastic outer tube, the connecting portion is integrally connected to the outer tube body, the structure is simple and no other complicated connecting structure is needed, therefore the space is saved, the volume of the liquid storage chamber is further increased, and the amount of liquid storage is also improved.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Embodiments of the present, disclosure are described more fully hereinafter with reference to the accompanying drawings. A preferred embodiment is described in the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Unless otherwise defined, all terms (including technical and scientific terms) used herein have the same meaning as commonly understood by one of ordinary skill in the art to which this invention belongs. The terms used herein is for the purpose of describing particular embodiments only and is not intended to limit the present disclosure. As used herein, the term "and/or" includes any and all combinations o one or more of the associated listed items.

Figure 1:
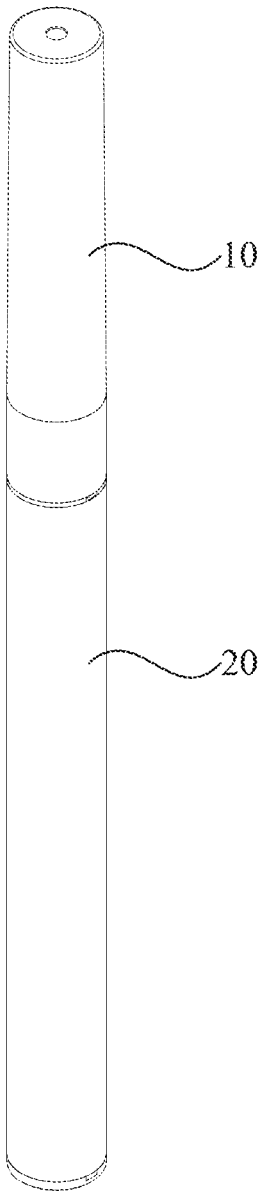
FIG. 1 is a perspective view of an electronic cigarette according to an embodiment.
Figure 2:
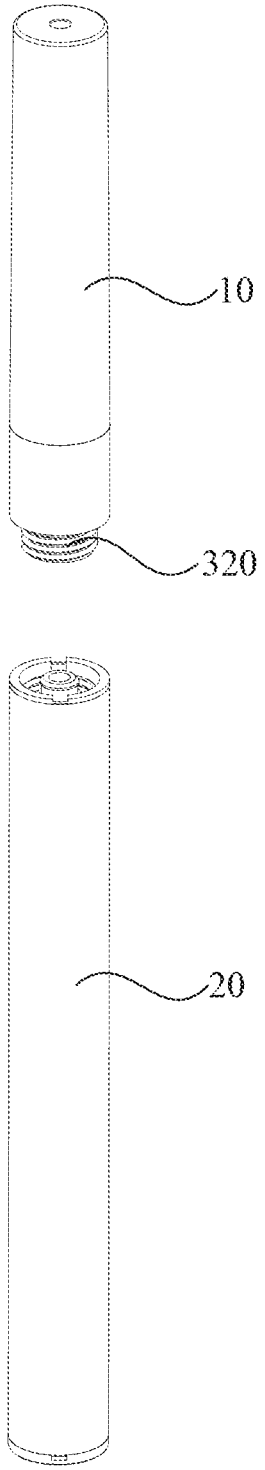
FIG. 2 is a perspective, exploded view of the electronic cigarette of FIG. 1.

Referring to FIG. 1 and FIG. 2, an electronic cigarette according to an embodiment includes an atomizer 10 and a battery device 20. The battery device 20 is connected to the atomizer 10 in a detachable manner, such as a threaded connection, and the battery device 20 is used to supply power to the atomizer 10.

Figure 3:
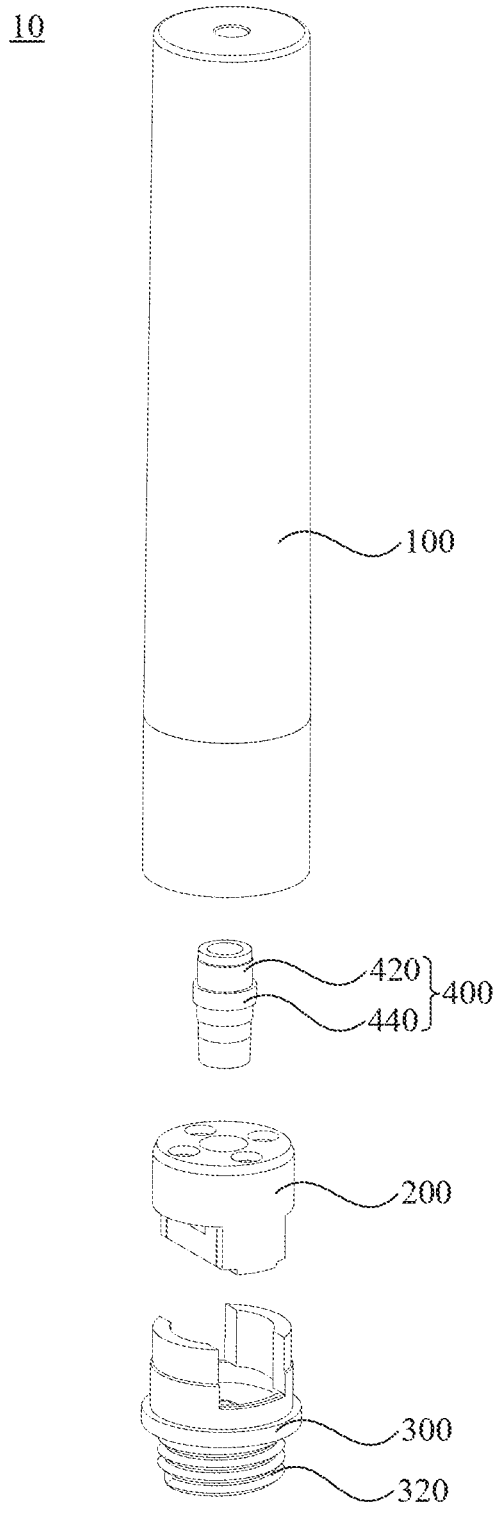
FIG. 3 is a perspective exploded view of an atomizer of the electronic cigarette of FIG. 1.
Figure 4:
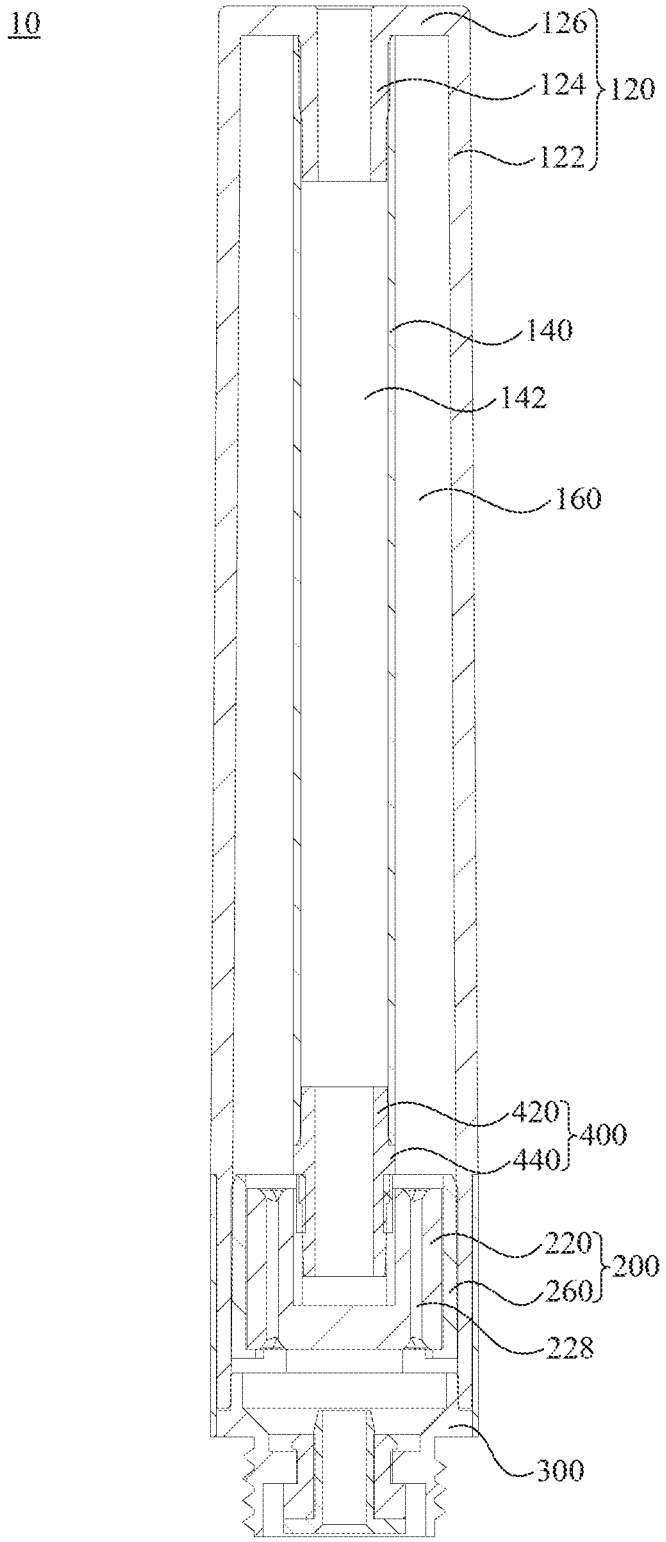
FIG. 4 is a cross-sectional view of the atomizer of the electronic cigarette of FIG. 1.

Referring to FIG. 3 and FIG. 4, the atomizer 10 includes a liquid storage assembly 100 and an atomizing assembly 200. The liquid storage assembly 100 includes a plastic outer tube 120 and a metal inner tube 140. The plastic outer tube 120 includes an outer tube body 122 and a connecting portion 124 located in the outer tube body 122, and the connecting portion 124 is integrally connected to the outer tube body 122. The metal inner tube 140 is located in the outer tube body 122, and the metal inner tube 140 is directly connected to the connecting portion 124. The metal inner tube 140 can be a stainless steel tube, a steel tube, a carbon tube, or any other tube mainly made of metal. The metal inner tube 140 defines an air inlet passage 142 therein, and a liquid storage chamber 160 is formed between the plastic outer tube 120 and the metal inner tube 140. The atomizing assembly 200 is connected to the liquid storage assembly 100, the atomizing assembly 200 is used to absorb e-liquid in the liquid storage chamber 160 and atomize the e-liquid. The atomizing assembly 200 defines an airflow passage 210 in communication with the air inlet passage 142.

Since the liquid storage assembly 100 includes the plastic outer tube 120 and the metal inner tube 140, in which the metal inner tube 140 can be fabricated very thin, and the structural strength can be guaranteed with this thin metal inner tube 140, thereby increasing the volume of the liquid storage chamber 160 and increasing the amount of liquid storage. Further, the metal inner tube 140 is directly connected to the connecting portion 124 of the plastic outer tube 120, the connecting portion 124 is integrally connected to the outer tube body 122, the structure is simple and no other complicated connecting structure is needed, therefore the space is saved, the volume of the liquid storage chamber 160 is further increased, and the amount of liquid storage is also increased.

Generally, there are two types of conventional liquid storage assembly. In the first type, the inner tube and the outer tube are integrally formed, and the tubes are both injection molded by plastic. Since the strength of the plastic is relatively weak, the wall of the inner tube should have certain thickness in order to meet certain mechanical properties. While the metal inner tube 140 employed in the present embodiment can have a greatly reduced thickness of the wall, the reduced wall thickness can significantly increase the amount of the liquid storage for the electronic cigarette with a less size. In the second type, the inner tube is made of metal and the outer tube is made of plastic or glass, however, this type of liquid storage usually has a complicated structure, and some connecting components are generally used to fix the inner tube and the outer tube. In the present embodiment, since the metal inner tube 140 is directly connected to the connecting portion 124 of the plastic outer tube 120, the overall structure of the liquid storage assembly 100 is much simpler.

In one of the embodiments, the plastic outer tube can also include an end wall 126 located at an end of the outer tube body 122. The connecting portion 124 has a tubular shape, an end of the connecting portion 124 is connected to the end wall 126 and is in communication with an outside. The metal inner tube 140 is sleeved on the connecting portion 124 via another end of the connecting portion 124, so as to facilitate assembling. The outer tube body 122, the end wall 126, and the connecting portion 124 are integrally connected, so as to facilitate injection molding.

Figure 5:
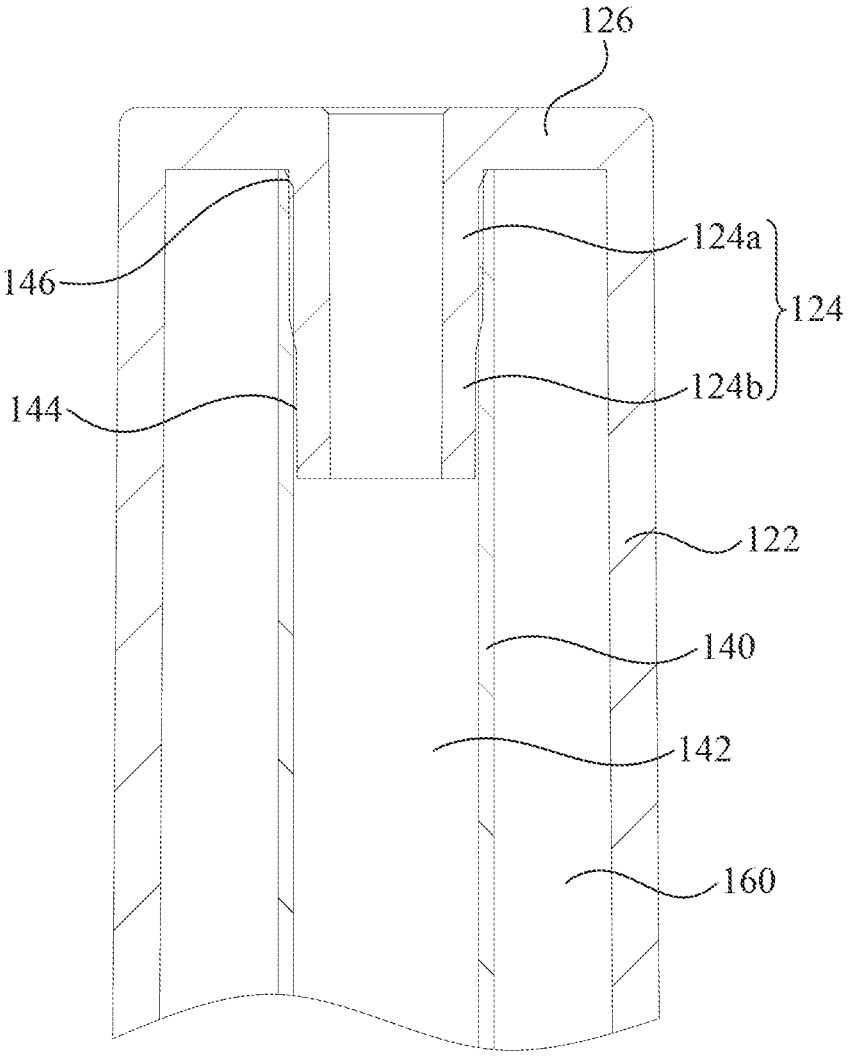
FIG. 5 is a partial enlarged view of an atomizing assembly of the electronic cigarette of FIG. 4.

Referring to FIG. 5, in one of the embodiments, the connecting portion 124 forms an interference fit with the metal inner tube 140, and the connecting portion 124 and the metal inner tube 140 are sealed therebetween, so as to prevent the liquid in the liquid storage chamber 160 from entering the air inlet passage 142. Specifically, an outer diameter of at least a portion of the connecting portion 124 may be slightly greater than an inner diameter of the metal inner tube 140, such that the connecting portion 124 can form an interference fit with the metal inner tube 140. In addition, in one of the embodiments, the connecting portion 124 can include a first portion 124*a* and a second portion 124*b*, the first portion 124*a* is connected to the end wall 126, and forms an interference fit with the metal inner tube 140, the second portion 124*b* is connected to the first portion 124*a*, and a slot 144 is formed between the second portion 124*b* and the metal inner tube 140. Specifically, an outer diameter of the second portion 124*b* is slightly greater than the inner diameter of the metal inner tube 140, such that the first portion 124*a* can be tightly engaged with the metal inner tube 140. An outer diameter of the second portion 124*b* can be slightly less than the inner diameter of the metal inner tube 140, such that the slot 144 is formed between the second portion 124*b* and the metal inner tube 140. The slot 144 can reduce the amount of condensed e-liquid on the inner wall of the metal inner tube 140 that flows into mouth of a user via the connecting portion 124.

In one of the embodiments, an end portion of the metal inner tube 140 can abut against the end wall 126, so as to achieve a double-sealed connection, and prevent the e-liquid in the liquid storage chamber 160 from entering the air inlet passage 142. In addition, in one of the embodiments, the end of the metal inner tube 140 is provided with a chamfer 146, which is adjacent to the connecting portion 124, so as to prevent the e-liquid from being contaminated by plastic debris scratched from the connecting portion 124 by the metal inner tube 140, when connecting the metal inner tube 140 to the connecting portion 124, and the connecting portion 124 extending into the metal inner tube 140.

Figure 6:
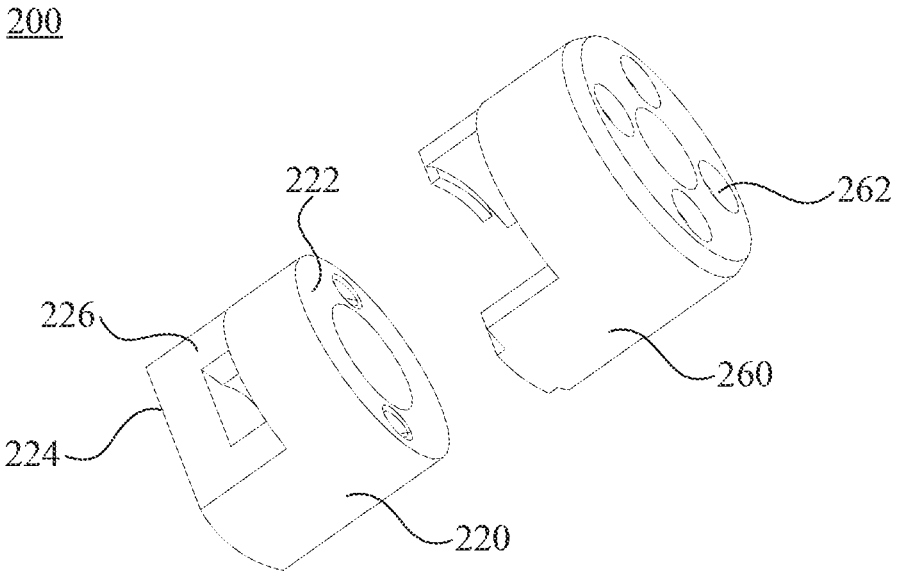
FIG. 6 is a perspective exploded view of the atomizing assembly of the electronic cigarette of FIG. 1.

Referring to FIG. 3 and FIG. 4 again, the atomizer 10 according to an embodiment further includes a connecting assembly 300 connected to the outer tube body 122. The connecting assembly 300 can limit the atomizing assembly 200 in the outer tube body 122. The connecting assembly 300 is used to connect to the battery device 20, and the connecting assembly 300 can be provided with a thread 320 for connecting the battery device 20. In one of the embodiments, the atomizer 10 further includes a connecting element 400, and the connecting element 400 includes a tubular portion 420 and a stepped portion 440 located outside the tubular portion 420. An end of the tubular portion 420 extends into the metal inner tube 140, another end of the tubular portion 420 extends into the airflow passage 210, and both sides of the stepped portion 440 abuts against the tubular portion 420 and the atomizing assembly 200, respectively, so as to facilitate mounting and positioning Referring also to FIG. 6, in one of the embodiments, the atomizing assembly. 200 includes a porous body 220 and a heating structure (not shown), the porous body 220 includes a liquid absorbing surface 222, an atomizing surface 224, and a side surface 226, the liquid absorbing surface 222 is used to absorb the e-liquid from the liquid storage chamber 160, and the heating structure is located on the atomizing surface 224. The airflow passage 210 passes through the atomizing surface 224 and is in communication with the air inlet passage 142, and at least one section of the airflow passage 210 extends from the side surface 226 to an inner side of the porous body 220.

The liquid absorbing surface 222 is used to absorb the e-liquid from the liquid storage chamber 160, and the heating structure located on the atomizing surface 224 is configured to atomize the e-liquid. The smoke generated at the atomizing surface 224 enters the airflow passage 210, at least one section of the airflow passage 210 extends from the side surface 226 to inside of the porous body 220. This section of airflow passage 210, on the one hand, can reduce a cross-sectional area of the heat conduction path of the atomizing surface 224 to the liquid absorbing surface 222, on the other hand, it can carry away a large amount of heat conducted from the atomizing surface 224 to the liquid absorbing surface 222, such that the heat transferred from the atomizing surface 224 to the liquid absorbing surface 222 can be greatly reduced, and the porous body 220 can be prevented from internal overheating, which causes the liquid or gas in the porous body 220 to expand, increasing the fluid pressure in the porous body 220 and blocking the transfer of the e-liquid. Therefore, the liquid conducting effect of the porous body 220 is improved. And it can be avoided that the e-liquid in the liquid storage chamber 160 absorbs greater heat from the liquid absorbing surface 222 and causing a waste of energy, and a change in the composition of the e-liquid caused by the rising temperature of the e-liquid is also avoided. Further, since the airflow can generate a negative pressure, the negative pressure can further accelerate the transfer of the e-liquid.

Figure 7:
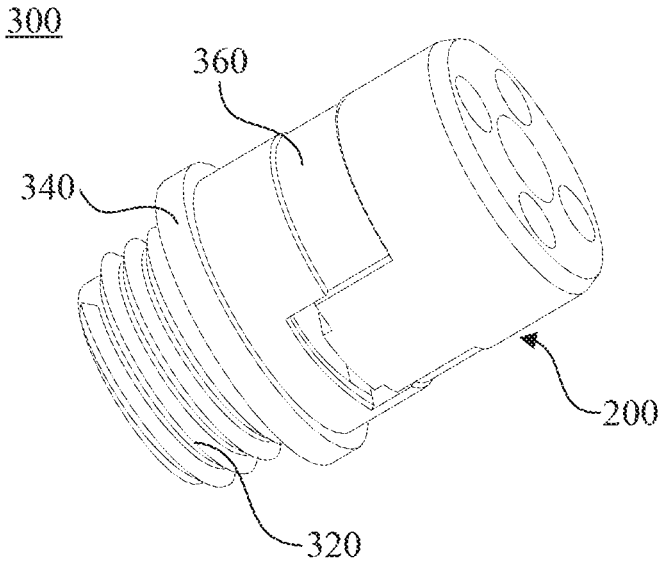
FIG. 7 is a perspective view of the atomizing assembly and a connecting assembly of the electronic cigarette of FIG. 1 in an engaged state.
Figure 8:
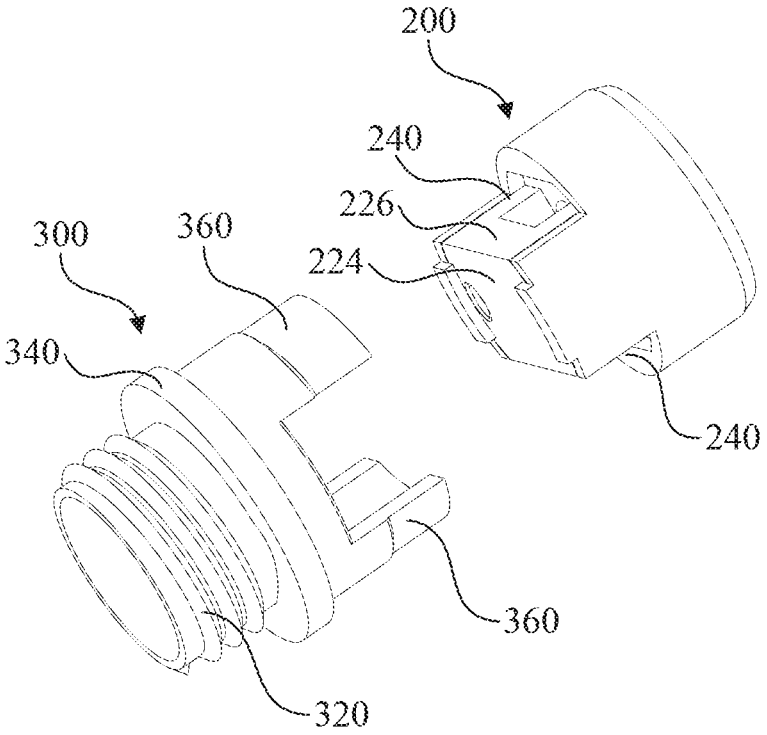
FIG. 8 is a perspective view of the atomizing assembly and the connecting assembly of the electronic cigarette of FIG. 7 in a detached state.

Referring to FIG. 7 and FIG. 8, in one of the embodiments, the atomizing assembly 200 is cylindrical, and a mounting notch 240 is defined on the atomizing assembly 200. The connecting assembly 300 includes a main body portion 340 and a buckling portion 360 extending from the main body portion 340. The thread 320 can defined on the main body portion 340, and the buckling portion 360 can extend into the mounting notch 240, such that the connecting assembly 300 is buckled to the atomizing assembly 200. The connecting assembly 300 and the atomizing assembly 200 are buckled by the mounting notch 240, which not only facilitates the installation, but also improves the structural stability.

Referring to FIG. 6 again, in one of the embodiments, the atomizing assembly 200 further includes a sealing gasket 260 wrapping at least a portion of the porous body 220. The sealing gasket 260 covers the liquid absorbing surface 222, and the sealing gasket 260 covering the liquid absorbing surface 222 defines a restriction hole 262, so as to function as a flow restrictor. The sealing gasket 260 further covers a joint between the porous body 220 and the outer tube body 122, and seals a gap between the porous body 220 and the outer tube body 122. The sealing gasket 260 may be made of silicone, or other material having a sealing and heat insulating function. The sealing gasket 260 covers the porous body 220, so as to reduce unnecessary evaporation of the e-liquid. The sealing gasket 260 also has the heat insulating function, so as to avoid external overheating of the electronic cigarette, and save the energy. The silicone gasket can also prevent hard contact between the porous body 220 and other parts, thereby preventing the porous body 220 from damages.

The porous body 220 is integrally formed, and the porous body 220 includes a liquid absorbing portion, an atomizing portion, and a liquid conducting portion located between the liquid absorbing portion and the atomizing portion. The liquid absorbing surface 222 is located on a side of the liquid absorbing portion away from the liquid conducting portion, and the atomizing surface is located on a side of he atomizing portion away from the liquid conducting portion.

Figure 9:
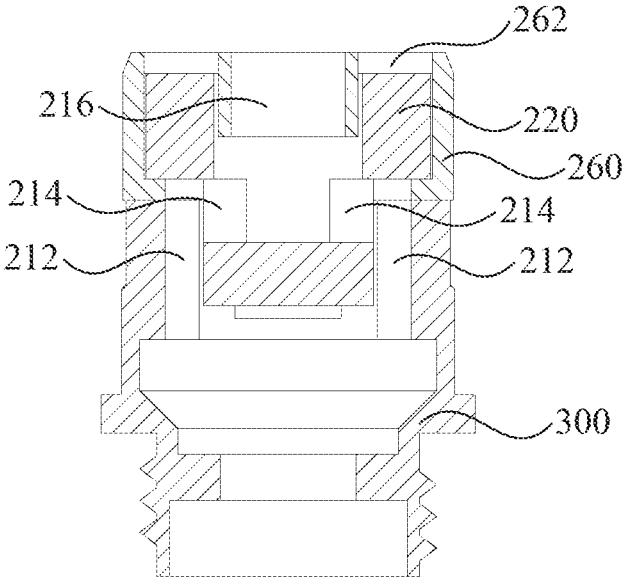
FIG. 9 is a cross-sectional view of the atomizing assembly and the connecting assembly of the electronic cigarette of FIG. 7.

Referring also to FIG. 9, the airflow passage 210 includes a first sub-passage 212, a second sub-passage 214, and a third sub-passage 216, that are sequentially communicated. The first sub-passage 212 is cooperatively formed by a side wall of the atomizing portion, a side wall of the liquid conducting portion, and an inner wall of the connecting assembly 300. The second sub-passage 214 is located in the liquid conducting portion, and extends into the liquid conducting portion via the side surface 226. The third sub-passage 216 is located in the liquid absorbing portion, and the third sub-passage 216 is in communication with the air inlet passage 142. The atomizing surface 224 generates atomization, the airflow takes away the smoke at the atomizing surface 224, enters the first sub-passage 212, then enters the third sub-passage 216 via the second sub-passage 214, and finally enters the mouth of the user through the air inlet passage 142.

Specifically, in one of the embodiments, the numbers of the first sub-passage 212 and the second sub-passage 214 are both two, the number of the third sub-passage 216 is one, and the third sub-passage 216 is located in the middle of the liquid absorbing portion. One ends of the two second sub-passages 214 are in communication with the two first sub-passages 212, respectively, and the other ends of the two second sub-passages 214 are both in communication with the third sub-passage 216. In other embodiments, the numbers of the first sub-passage 212 and the second sub-passage 214 may both be three or four. If the number is smaller, it is easy to process, and the greater the number, the better the heat dissipation effect.

In one of the embodiments, after a wire supplying power to the heating structure extends through the porous body 220 from the atomizing surface 224, a tail end of the wire is welded to the liquid absorbing surface 222, so as to ensure a firm connection of the wire. Referring to FIG. 4, although the wire of the heating structure is not shown in FIG. 4, a hole 228 is reserved for the wire in the porous body 220, as can be seen in FIG. 4.

The heating structure may be a heating film or a heating circuit layer. The heating circuit layer can be plated on the atomizing surface 224. The heating film may he a porous heating film formed on the atomizing surface 224 via a vapor deposition method, and the porous heating film has a thickness ranging from 0.5 μm to 1.5 μm. The micropores on the porous heating film can greatly increase the contact area with the e-liquid, and improve the atomizing efficiency. Preferably, the thickness of the porous heating film ranges from 0.8 μm to 1 μm.

The porous heating film is located on the atomizing surface 224 of the porous body 220, such that the atomized e-liquid can escape from the porous body 220, and the porous heating film can uniformly heat the surface of the porous body 220, such that the temperature of the atomizing action is uniform. Therefore, the problem that the atomized particles are too large due to the low local temperature will he avoided, thus ensuring uniformity of the atomized particles and improving the taste of the electronic cigarette. In one of the embodiments, the micropores on the porous heating film have a diameter ranging from 5 μm to 30 μm. Further, in one of the embodiments, the thickness of the porous heating film is less than the pore diameter of the micropores on the porous body 220.

In one of the embodiments, the porous body 220 is a porous ceramic body, and the micropores of the porous body 220 have a diameter ranging from 1 μm to 100 μm, and the porosity of the porous body 220 is from 30% to 83%. The porosity can be adjusted according to the compositions of different e-liquid. For example, for e-liquid with greater viscosity, a higher porosity is required. Specifically, in an embodiment, a volume of the micropores on the porous body 220 with a pore diameter ranging from 5 μm to 30 μm accounts for 60% or more of the volume of all micropores, such that the porous body 220 has a moderate penetration effect.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although the present disclosure is illustrated and described herein with reference to specific embodiments, the present disclosure is not intended to be limited to the details shown. It is to be rioted that, various modifications may be made in the details within the scope and range of equivalents of the claims and without departing from the present disclosure. Therefore, the protection scope of the present disclosure shall be subject to the protection scope of the claims.

What is claimed is:

1. An atomizer of an electronic cigarette, comprising:

a liquid storage assembly comprising a plastic outer tube and a metal inner tube, wherein the plastic outer tube comprises an outer tube body and a connecting portion located in the outer tube body, and the connecting portion is integrally connected to the outer tube body; the metal inner tube is located in the outer tube body, and the metal inner tube is directly connected to the connecting portion; the metal inner tube defines an air inlet passage therein, and an inner wall of the plastic outer tube and an outer wall of the metal inner tube form a liquid storage chamber therebetween; and an atomizing assembly connected to the liquid storage assembly, wherein the atomizing assembly is configured to absorb e-liquid in the liquid storage chamber and atomize the e-liquid; the atomizing assembly defines an airflow passage in fluid communication with the air inlet passage.

2. The atomizer of the electronic cigarette according to claim 1, wherein the plastic outer tube further comprises an end wall located at an end of the outer tube body, the connecting portion has a tubular shape, an end of the connecting portion is connected to the end wall and is in fluid communication with an outside, the metal inner tube is sleeved on the connecting portion via another end of the connecting portion; and the outer tube body, the end wall, and the connecting portion are integrally connected.

3. The atomizer of the electronic cigarette according to claim 2, wherein the connecting portion forms an interference fit with the metal inner tube, and the connecting portion and the metal inner tube are sealed therebetween.

4. The atomizer of the electronic cigarette according to claim 3, wherein an end of the metal inner tube abuts against the end wall.

5. The atomizer of the electronic cigarette according to claim 3, wherein the end of the metal inner tube is provided with a chamfer, and the chamfer is adjacent to the connecting portion.

6. The atomizer of the electronic cigarette according to claim 3, wherein the connecting portion comprises a first portion and a second portion, the first portion is connected to the end wall, and forms an interference fit with the metal inner tube, the second portion is connected to the first portion, and a slot is formed between the second portion and the metal inner tube.

7. The atomizer of the electronic cigarette according to claim 1, further comprising a connecting assembly connected to the outer tube body, wherein the connecting assembly is configured to limit the atomizing assembly inside the outer tube body.

8. The atomizer of the electronic cigarette according to claim 7, further comprising a connecting element comprising a tubular portion and a stepped portion located outside the tubular portion; wherein an end of the tubular portion extends into the metal inner tube, another end of the tubular portion extends into the airflow passage, and both sides of the stepped portion abuts against the tubular portion and the atomizing assembly, respectively.

9. The atomizer of the electronic cigarette according to claim 7, wherein the atomizing assembly comprises a porous body and a heating structure, the porous body comprises a liquid absorbing surface, an atomizing surface, and a side surface; the liquid absorbing surface is configured to absorb thee-liquid from the liquid storage chamber, and the heating structure is located on the atomizing surface; the airflow passage passes through the atomizing surface and is in fluid communication with the air inlet passage, and at least one section of the airflow passage extends from the side surface to an inner side of the porous body.

10. The atomizer of the electronic cigarette according to claim 9, wherein the atomizing assembly further comprises a sealing gasket wrapping at least a portion of the porous body; the sealing gasket covers the liquid absorbing surface, and the sealing gasket covering the liquid absorbing surface defines a restriction hole, the sealing gasket further covers a joint between the porous body and the outer tube body, and seals a gap between the porous body and the outer tube body.

11. The atomizer of the electronic cigarette according to claim 9, wherein the atomizing assembly is cylindrical and defines a mounting notch, the connecting assembly comprises a main body portion and a buckling portion extending from the main body portion, and the buckling portion extends into the mounting notch, such that the connecting assembly is bucked to the atomizing assembly.

12. The atomizer of the electronic cigarette according to claim 9, wherein the porous body is integrally formed, the porous body comprises a liquid absorbing portion, an atomizing portion, and a liquid conducting portion located between the liquid absorbing portion and the atomizing portion; the liquid absorbing surface is located on a side of the liquid absorbing portion away from the liquid conducting portion, and the atomizing surface is located on a side of the atomizing portion away from the liquid conducting portion.

13. The atomizer of the electronic cigarette according to claim 12, wherein the airflow passage comprises a first sub-passage, a second sub-passage and a third sub-passage that are sequentially fluidly communicated, the first sub-passage is cooperatively formed by a side wall of the atomizing portion, a side wall of the liquid conducting portion, and an inner wall of the connecting assembly, the second sub passage is located in the liquid conducting portion and extends into the liquid conducting portion via the side surface, the third sub-passage is located in the liquid absorbing portion, and the third subpassage is in fluid communication with the air inlet passage.

14. The atomizer of the electronic cigarette according to claim 9, wherein the heating structure is a heating film or a heating circuit layer.

15. The atomizer of the electronic cigarette according to claim 14, wherein the heating film is a porous heating film having a thickness ranging from 0.5 μm to 1.5 μm.

16. The atomizer of the electronic cigarette according to claim 15, wherein a micropore on the porous heating film has a diameter ranging from 5 μm to 30 μm.

17. The atomizer of the electronic cigarette according to claim 15, wherein the thickness of the porous heating film is less than a diameter of a micropore on the porous body.

18. The atomizer of the electronic cigarette according to claim 9, wherein after a wire supplying power to the heating structure extends through the porous body from the atomizing surface, a tail end of the wire is welded to the liquid absorbing surface.

19. The atomizer of the electronic cigarette according to claim 1, wherein the metal inner tube is a stainless steel tube.

20. An electronic cigarette, comprising a battery device and an atomizer according to claim 1, wherein the battery device is connected to the atomizer to supply power to the atomizer.

* * * * *